US008721410B2

(12) United States Patent
Friebel et al.

(10) Patent No.: US 8,721,410 B2
(45) Date of Patent: May 13, 2014

(54) WALL SLEEVE

(75) Inventors: Wolf-Christopher Friebel, Wallenhorst (DE); Hans-Joachim Naber, Nordhorn (DE)

(73) Assignee: Naber Holding GmbH & Co. KG, Nordhorn (DE)

( * ) Notice: Subject to any disclaimer, the term of this patent is extended or adjusted under 35 U.S.C. 154(b) by 1946 days.

(21) Appl. No.: 11/939,194

(22) Filed: Nov. 13, 2007

(65) Prior Publication Data

US 2008/0153410 A1 Jun. 26, 2008

(30) Foreign Application Priority Data

Nov. 11, 2006 (DE) ..... 10 2006 053 208
Aug. 29, 2007 (DE) ..... 10 2007 040 731

(51) Int. Cl.
*F24F 13/12* (2006.01)
*F24F 13/10* (2006.01)
*F24F 7/00* (2006.01)

(52) U.S. Cl.
USPC ..... 454/273; 454/274

(58) Field of Classification Search
USPC ..... 454/273, 274
See application file for complete search history.

(56) References Cited

U.S. PATENT DOCUMENTS 774,053 A * 11/1904 Edwards ..... 454/273
1,159,654 A * 11/1915 Davis ..... 454/273
2,218,348 A * 10/1940 Boyer ..... 454/352
2,556,277 A * 6/1951 Hill et al. ..... 244/57
2,611,608 A * 9/1952 Braskamp ..... 454/273
2,739,521 A * 3/1956 Spear ..... 454/349
2,854,916 A * 10/1958 Knutson et al. ..... 454/352
3,005,887 A * 10/1961 Robson ..... 200/81.9 R
3,144,043 A * 8/1964 Arnold et al. ..... 137/461
3,385,944 A * 5/1968 Mackiewicz et al. ..... 200/305
3,541,945 A * 11/1970 Wexler ..... 454/359
3,826,183 A * 7/1974 Rudine ..... 454/348
4,145,961 A 3/1979 Lolli
4,455,232 A * 6/1984 Reid ..... 210/628
5,421,775 A * 6/1995 Honda ..... 454/274
5,716,271 A 2/1998 Paidosh
5,775,988 A 7/1998 Eakin
5,924,922 A * 7/1999 Eakin et al. ..... 454/270
6,527,006 B2 * 3/2003 Jackson ..... 137/527.6

(Continued)

FOREIGN PATENT DOCUMENTS

CH 83455 12/1919
DE 76 38 350.1 U 3/1977

(Continued)

OTHER PUBLICATIONS

Daniels, DE 2718298 English machine translation, Apr. 15, 1977.*

(Continued)

*Primary Examiner* — Kang Hu
*Assistant Examiner* — Phillip E Decker
(74) *Attorney, Agent, or Firm* — Browdy and Neimark, PPLC

(57) ABSTRACT

The invention relates to a wall sleeve with a ventilation opening at a guide tube (2), and a cover plate (5), which is mounted at the end of the guide tube and can be moved between a closing position and an open position, said cover plate (5) automatically opening and closing against a reset force, propelled by the pressure difference between the air pressure in the guide tube (2) and the external ambient air.

33 Claims, 3 Drawing Sheets

(56) References Cited

U.S. PATENT DOCUMENTS

| | | | | |
|---|---|---|---|---|
| 6,604,994 | B2 * | 8/2003 | Achen | 454/271 |
| 6,676,508 | B1 * | 1/2004 | Graham | 454/270 |
| 7,775,322 | B2 * | 8/2010 | Hill | 181/254 |
| 2007/0196665 | A1 * | 8/2007 | Tenra et al. | 428/416 |

FOREIGN PATENT DOCUMENTS

| | | | | |
|---|---|---|---|---|
| DE | 27 18 298 | A1 | 4/1977 | |
| DE | 27 27 180 | A1 | 6/1977 | |
| DE | 26 00 735 | A1 | 1/1978 | |
| DE | 36 00 821.4 | A1 | 1/1986 | |
| DE | 39 39 418 | C2 | 11/1989 | |
| DE | 39 39 658 | C2 | 11/1989 | |
| DE | 4405739 | C1 * | 7/1995 | F24F 3/056 |
| DE | 10 2004 058 775 | A1 | 6/2006 | |
| DE | 20 2005 012 770 | U1 | 8/2006 | |
| EP | 0 466 232 | A1 | 6/1997 | |
| EP | 1921394 | A1 * | 5/2008 | F24F 11/047 |
| GB | 587 738 | | 5/1947 | |
| GB | 1 244 725 | | 11/1967 | |
| GB | 1556533 | | 11/1979 | |
| JP | 59109259 | A * | 6/1984 | B03C 3/82 |
| NL | 1021839 | | 11/2002 | |
| SU | 1076201 | A * | 2/1984 | |
| WO | 84/01615 | | 4/1984 | |
| WO | WO 8604493 | A1 * | 8/1986 | |
| WO | 96/39808 | | 12/1996 | |

OTHER PUBLICATIONS

Muller, DE 3939418 English machine translation, Nov. 29, 1989.*

* cited by examiner

WALL SLEEVE

The invention relates to a wall sleeve with a ventilation opening at a guide tube, and a cover plate, which is mounted at the end of the guide tube and can be moved between a closing position and an open position.

Wall sleeves are used for ventilating rooms, kitchens for example, by means of a blower and a guide tube leading to the outside which is closed with a cover plate. From DE 20 2005 010912.6 it is known to open and close the cover plate electrically by switching the blower on and off. But often no direct electrical connection between the wall sleeve- and the blower can be made.

In this case, the utility model DE 20 2006 006327 U1 provides a sensor in the wall sleeve, which detects the air flow and/or the air pressure, and depending on that an electronic controller opens or closes the cover plate. This type of wall sleeve permanently requires energy and therefore an electric cable for the power supply is still to be connected to the wall sleeve. Furthermore, the construction of the wall sleeve is relatively complicated and expensive to manufacture. It is susceptible to faults, especially with pollution in the air, and because of the cables and hoses, costly to install.

It is the object of the invention, to indicate a wall sleeve of the generic kind that works without the supply of electrical energy, is built simply, easy to mount and, in particular, further reduces pressure losses.

This object is met in such a way, that the cover plate, driven by the pressure difference between the air pressure in the guide tube and the external ambient air, opens and closes automatically against the elastic resilience of a spring.

Embodiments of the invention are represented in the subclaims.

With the wall sleeve according to the present invention an inexpensive venting product which is easy to assemble is revealed. With the energy of the air flow the wall sleeve opens automatically to the desired width. At the same time the guide tube can have a round, oval or almost rectangular cross section. As soon as no more air flow remains, the cover plate of the wall sleeve closes tight and prevents the discharge and the ingress of air. A control system and/or wiring of the wall sleeve are not necessary.

In order to realize these functions the cover plate is conducted axially on guide arms inside the guide tube.

The pressure loss through the wall sleeve is minimized if on the inside of the cover plate an air stream body is mounted, which leads the air flow, caused by the pressure difference, past the rim of the cover plate to the outside. In this case a hyperbolic shaped air stream body turned out to be particularly suitable and that the extending force through the air flow is high.

The air flow is channeled by an air stream body and an additional air baffle in such a way, that it exits at the rim of the cover plate without turbulences. This adds up to a low pressure loss, and also a pollution of the wall with outgoing air, for example polluted with fat particles, is largely avoided.

At the same time the air baffle is firmly connected by the guide arms with the air stream body, so that it can move along with this.

The air baffle is preferably formed as a funnel-shaped ring, which in combination with the air stream body brings about an optimal air flow redirection with low pressure loss. The curvature of the ring is shaped in such a way, that inside it runs horizontally at first, and then deflects the flow by approximately 70° to the outward.

The described arrangement of the air stream body with the air baffle is present in both circular and conventional rectangular ventilation tubes (the so-called flat-channels), for which in each case an appropriate guide tube and a cover plate with the appropriate air stream body and air baffle are provided.

With a circular guide tube, the air stream body and the air baffle are constructed in an axially symmetrical way, with an essentially angular guide tube, the air stream body and the air baffle respectively presenting hyperbolic surfaces.

The air stream body is preferably composed of a plastic sheathing, which is filled with an insulating material and closed with the cover plate. This construction provides a good insulation against external weather influences.

The plastic sheathing supports also the guide arms, which conduct the assembly group of air stream body, air baffle and cover plate inside the guide tube.

In one embodiment the reset force for closing the cover plate is caused by the own weight of the cover plate and by its guide conduct on inclined track ways. In another embodiment, the reset force is produced by a spring, which draws the cover plate into its closing position. In the embodiment with the spring, said spring affects the centre of the cover plate by means of a swinging lever. The other end of the spring is attached on the inner surface of the guide tube, like the jointed swinging lever. At the same time the swinging lever is guided at the centre of the cover plate by means of a rod. In such a way a tilting of the cover plate is prevented.

In a preferred embodiment, the reset force is produced by a pre-tensioned pull-spring, which affects the air stream body by means of a bell crank lever. For this purpose the bell crank lever is connected with the centre of the cover plate by a con-rod or a thread. By an appropriate choice of swinging lever lengths, of the angle between the lever arms and the angle between the swinging lever and the spring axis, a desired load v. displacement characteristic of the reset force can be realized.

An increase or a decrease of the reset force is possible by a corresponding change of the spring's point of application on the lever.

In an alternative embodiment, the reset force is produced by a weight, which is attached to one end of a V-shaped swinging lever, and whose other end affects the centre of the cover plate. At the same time the swinging lever is hinged jointed in the guide tube. Due to the gravity of the weight and the adjustable length of the lever arms different force progressions can be set. In this case, it is preferable to produce a high reset force in the closing position of the wall sleeve and a lower one in the extension position. In such a way, the wall sleeve is safely closed in the idle state, and during operating state only a low pressure loss is caused.

In another embodiment, the reset force is produced by a revolving spring, which also affects the centre of the air stream body by means of a swinging lever. The revolving spring has an essentially linear force progression.

The cover plate is guided by at least two guide arms in the guide tube. This way a smoothly-running guide conduct and a bearing without tilting is possible. At the same time the guide arms can also be formed as a linear pullout or a linear guidance. For weight savings notches in the guide arms can be present.

A particularly smooth-running guide conduct is attained with roller bearings at the guide arms, said bearings rolling at the inner surface of the guide tube. In such a way out-of-roundness and other nonconformities with the ideal form are compensated, if the rolling bearings are resiliently hinged. Furthermore, it is advantageous if an inclination of the guide tube is compensated by adjusting the spring tension or its springiness.

The air stream body can also serve as an additional external insulation of the guide tube. Furthermore, it is advantageous if an additional insulation is provided between cover plate and guide tube, said insulation preventing an exchange of air in the closing position.

The smooth running is further improved if as little mass as possible is moved. For this purpose it is advantageous to provide the guide arms with notches in order to reduce weight. It is also advantageous to manufacture the guide arms and the air stream body from plastic.

The air stream body is preferably composed of a plastic sheathing, which is filled with an insulating material and closed with the cover plate. This construction provides a good insulation against external weather influences. The plastic sheathing also supports the guide arms, which conduct the assembly group of air stream body, air baffle and cover plate inside the guide tube.

The distance between the exhaust opening and the cover plate depends on the pressure difference and the air flow volume respectively. As a consequence this volume can easily be determined by measuring the distance. For this purpose markings can be tagged to the guide arms, which then are captured optically.

The wall sleeve holds a circumferential flange at the exterior end of the guide tube, by means of which it is mounted in the wall. A sealing ring is embedded in the flange, which assures the sealing of the cover plate in the closing position.

The sealing is further improved by magnets, which are embedded in the flange and the cover plate. These magnets also provide for the precise vertical orientation of the cover plate in the closing position. This way an unwanted twisting is avoided, if deploying decorative plates with asymmetrical motifs, a house number for example.

Also the magnets further improve the extension, since before opening a pressure is built up, which causes the wall sleeve, even at low volume flows, to extend further, than it would be the case without magnets.

Advantageously, fins are attached at the flange of the guide tube, which reach in the wall opening and serve as a safe seat of the wall sleeve during the assembly. By means of the fins the guide tube is centered and secured against twists.

Different decorative plates can be attached to the cover plate. An easy replacement is possible if a central screw is used, which extends into the cover plate.

The decorative plate can also be designed as a lamp. The higher weight of a lamp compared to a normal decorative plate is counterbalanced by an increase of the reset force.

Another feature may be that a small wind generator is incorporated in the guide tube. The produced electricity can be used to actuate visual effects, for example the flashing of light emitting diodes, indicating an operating condition.

Types of execution of the invention are described in the figures by way of example.

Figure 1:
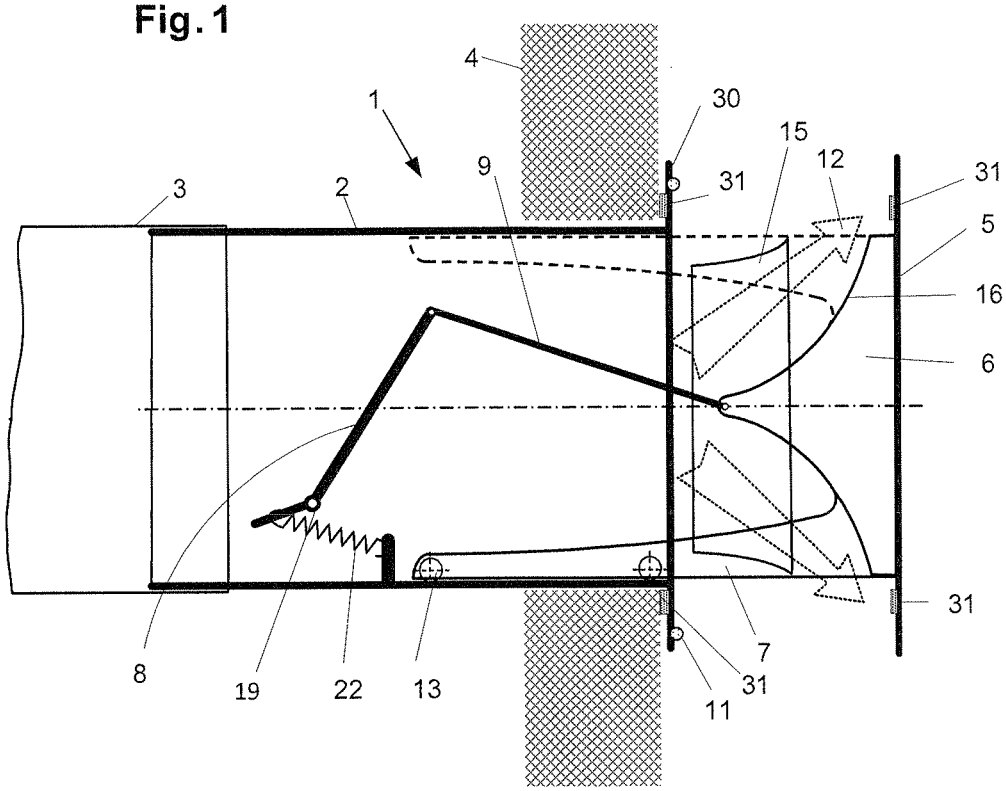
FIG. 1 shows the cross section of a wall sleeve in the open position
Figure 2:
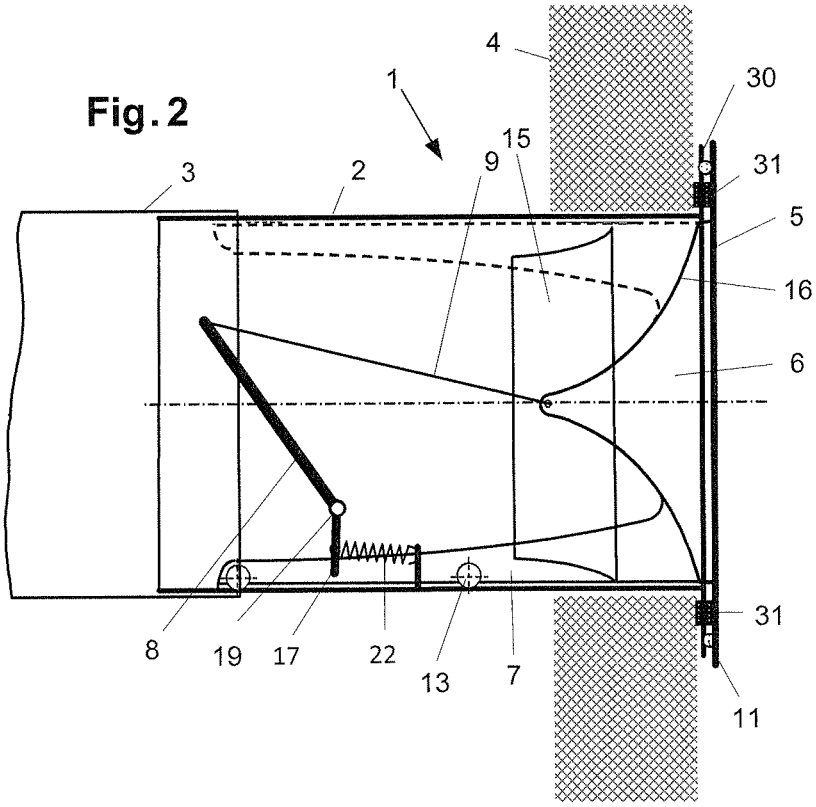
FIG. 2 shows the same wall sleeve in the closing position.

In FIGS. 1 and 2 a wall sleeve 1 with his guide tube 2 in the wall 4 is represented. The ventilation tube 3 is plugged on from inside. The cover plate 5 is held against the closing pressure by the air flow 12 in the open position, as shown in FIG. 1. If the air flow 12 is missing, as shown in FIG. 2, the closing pressure closes the cover plate on the wall opening. The cover plate 5 is guided by guide arms 7, one of which is shown with dashed lines. The guide arm 7 slides with the bearings 13 in the guide tube 2.

On the inside of the cover plate 5 the air stream body 6 is attached, which leads the air flow past the outer rim of the cover plate 5 to the outside. The air stream body has a hyperbolic shaped surface 16, which is particularly aerodynamic. The air flow 12 is further directed by the air baffle 15 in such a way that an air flow with low turbulence is formed, which exercises a maximum force on the air stream body 6. This configuration causes a minimal loss of pressure for the air flow 12.

The closing pressure is produced by a pull spring 22 attached to a swinging lever 8, which in turn is supported the hinge bearing 19. The strength of the pull spring 22 and its attachment at the swinging lever 8 results in a load v. displacement characteristic for the closing pressure, which in the closing position is characterized by an almost constant progress of the closing pressure. The closing pressure is transferred to the air stream body 6, and therewith to the cover plate 5, by the rod 9, or by a thread. The seal 11 in the flange 30 of the wall sleeve 1 seals the cover plate 5 in the closing position additionally.

Furthermore, several magnets 31 are provided on the cover plate 5 and on the flange 30, further increasing the closing pressure in the closing position. The magnets 31 serve also to centre the cover plate 5, so that the angle between the cover and the wall remains still unchanged after multiple opening and closing movements.

Figure 3:
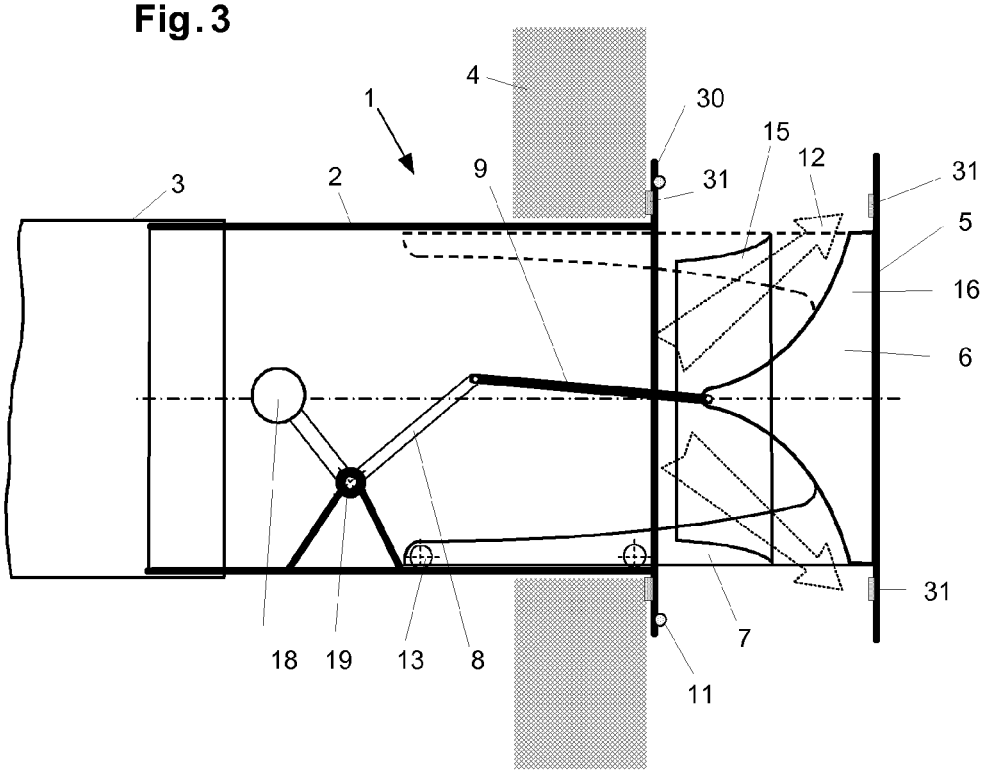
FIG. 3 shows the wall sleeve with a weight generating the reset force.

FIG. 3 shows an alternative mechanism for the generation of reset force in a wall sleeve according to FIG. 1 and FIG. 2. In this execution, the reset force is generated by a weight 18 mounted to a bell crank lever 8. The position of the weight on the bell crank lever 8, which in turn is supported in the hinge bearing 19, is adjustable. The size of the weight 18 and the length of the lever arms of the swinging lever 8 result in a load v. displacement characteristic for the closing pressure, which is characterized by an almost constant progress of the closing pressure.

Figure 4:
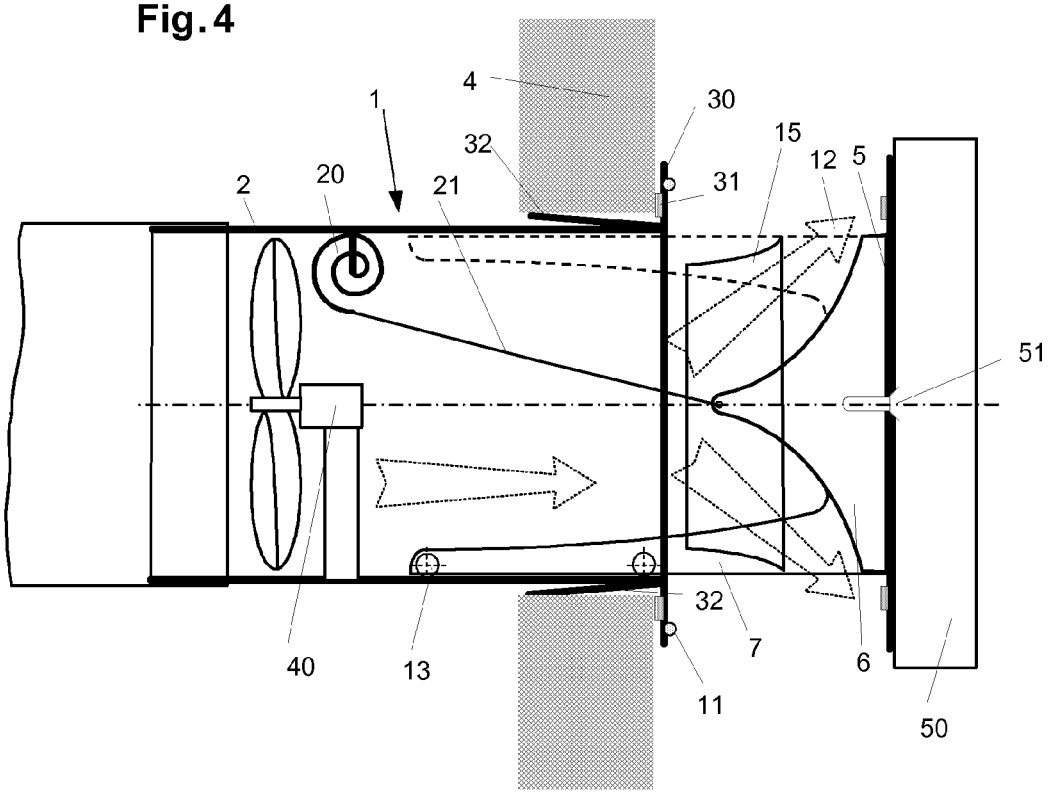
FIG. 4 shows a wall sleeve with additional equipment.

In FIG. 4 a similar wall sleeve as in FIG. 1 is represented in the open position. In this execution, the closing pressure is produced by the torsion spring 20, which has an essentially linear rising spring characteristic line. It affects via the spring lever 21 the air stream body 6.

The air flow 12 also propels a wind generator 40, whose energy can be used for optical displays, for illuminants (LEDs), or also for charging a rechargeable battery.

Furthermore, fins 32 are attached at the guide tube 2, providing a firm fit when mounting the wall sleeve in a wall, for example as long as a polyurethane foam is not yet hardened.

Another decorative element 50 is mounted on the cover plate 5; said element can show a wide range of motifs and designs. This decorative element 50 is connected by a central screw 51 with the cover plate 5 and the air stream body 6.

The decorative element 50 can be designed, for example, as a lamp.

Figure 5:
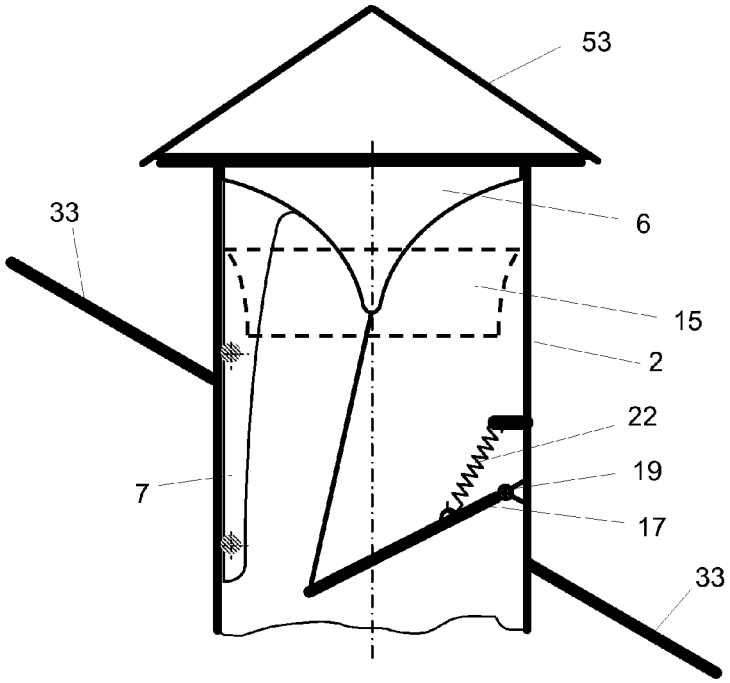
FIG. 5 shows a vertically installed wall sleeve.

In FIG. 5 the wall sleeve is shown in a vertical mounting position in a roof 33, which especially with attic flats can be advantageous.

In this case a rain cover 53 is mounted instead of a decorative plate.

In this case the reset force is brought into effect by the weight of all movable parts. Since this weight is too great to open the wall sleeve by means of the air flow far enough automatically, a pull spring 22 is provided, which affects a swinging lever 17, supported in the hinge bearing 19, in such a way, that the spring force of the pull spring 22 acts contrary to the weight force. In this way the air flow also in this installation situation can open the wall sleeve.

REFERENCE SIGNS

1 wall sleeve
2 guide tube
3 ventilation tube
4 wall
5 cover plate
6 air stream body
7 guide arm
8 swinging lever
9 rod
11 seal
12 air flow
13 bearing
15 air baffle
16 hyperbolic surface
17 swinging lever
18 weight
19 hinge bearing
20 torsion spring
21 spring lever
22 pull spring
30 flange
31 magnets
32 fins
33 roof
40 wind generator
50 decorative plate
51 screw
53 rain cover

The invention claimed is:

1. Wall sleeve between an inside and an outside of a wall (4), comprising: a guide tube (2); a ventilation opening at an end of the guide tube (2); and a cover plate (5), which is mounted at the end of the guide tube and can be moved by a pressure difference of an airflow between a closing position and an open position, at an inside of which is formed a hyperbolically shaped air stream body (6), characterized in that the cover plate (5) is conducted along a central axis on guide arms (7) in the guide tube (2), and an air baffle (15) streamlined as a funnel shaped ring is mounted on said cover plate (5), wherein the funnel shaped ring of the air baffle (15) at first runs parallel to a central axis of the guide tube (2) on the inside, and then widens in such a way that the airflow is deflected outwards by approximately 70° in relation to the central axis, and the cover plate (5) automatically opens and closes against a reset force, propelled by the pressure difference between an air pressure in the guide tube (2) and an external ambient air thereby leading the air flow to a rim of the cover plate (5) and to the outside.

2. Wall sleeve according to claim 1, characterized in that the guide tube (2) has a round, oval or rectangular cross section.

3. Wall sleeve according to claim 1, characterized in that the reset force is caused by the weight of the movable cover plate (5) on inclined track ways (14).

4. Wall sleeve according to claim 1, characterized in that the reset force is produced by a spring (22) which affects the cover plate (5) and draws it to the closing position.

5. Wall sleeve according to claim 4, characterized in that the spring (22) works on a swinging lever (8) which on one end is hinged jointed on an inner surface of the guide tube (2), and on the other end affects a centre of the cover plate (5).

6. Wall sleeve according to claim 5, characterized in that the swinging lever (8) is connected by means of a con-rod (9) to the centre of the cover plate (5).

7. Wall sleeve according to claim 4, characterized in that a spring preload and/or a spring stiffness of the spring (22) are adjustable.

8. Wall sleeve according to claim 4, characterized in that an inclination of the guide tube (2) is compensated by an adjustment of the spring tension.

9. Wall sleeve according to claim 1, characterized in that the reset force is transferred to the centre of the air stream body (6) by a pre-tensioned pull-spring (22), via a hinged jointed V-shaped swinging lever (17).

10. Wall sleeve according to claim 9, characterized in that the position of the point of application of the spring force at the swinging lever (17) is adjustable.

11. Wall sleeve according to claim 9, characterized in that the pressure difference is measured by an angularity of the swinging lever (17), or an extension distance of the cover plate (5).

12. Wall sleeve according to claim 1, characterized in that the reset force is produced by a weight (18) at one end of a hinged jointed V-shaped swinging lever (17), whose other end is connected with the centre of the air stream body (6).

13. Wall sleeve according to claim 12, characterized in that the swinging lever (8) is connected via a con-rod (9), or a thread with the centre of the cover plate (5).

14. Wall sleeve according to claim 12, characterized in that the position of the weight (18) at the swinging lever (17) is adjustable.

15. Wall sleeve according to claim 1, characterized in that the reset force is produced by means of a torsion spring (20), which affects the centre of the air stream body (6) via a lever (21).

16. Wall sleeve according to claim 1, characterized in that at least two guide arms (7) are placed inside the guide tube (2).

17. Wall sleeve according to claim 16, characterized in that the guide arms (7) are formed as a linear guidance or as a linear pullout.

18. Wall sleeve according to claim 16, characterized in that the guide arms (7) in the guide tube are guided with roller bearings (13).

19. Wall sleeve according to claim 18, characterized in that the roller bearings (13) are hinged resiliently.

20. Wall sleeve according to claim 1, characterized in that the air baffle (15) is permanently fixed to the guide arms (7).

21. Wall sleeve according to claim 1, characterized in that the hyperbolically-shaped surfaces (16) of the air stream body (6) are axially symmetrical in the case of a round guide tube (2), and accordingly, in the case of a rectangular guide tube (2), are aligned with the sides.

22. Wall sleeve according to claim 1, characterized in that the air stream body (6) has a plastic sheathing with a filling of insulating material.

23. Wall sleeve according to claim 1, characterized in that a seal (11) is provided at the seat-engaging surface of the cover plate (5) towards the guide tube (2).

24. Wall sleeve according to claim 1, characterized in that the cover plate (5) serves as a decorative plate on the outside.

25. Wall sleeve according to claim 1, characterized in that a replaceable decorative plate (50) is mounted on the cover plate (5).

26. Wall sleeve according to claim 1, characterized in that, in the case of a non-horizontal installation of the wall sleeve, the reset force is produced by the own weight of the cover plate (5), the air stream body (6), the air baffle (15) and the guide arms (7), and is reduced by pre-tensioned spring force acting against the weight force.

27. Wall sleeve according to claim 1, characterized in that the air flow during air delivery mode is directed from the outside into the house.

28. Wall sleeve according to claim 1, characterized in that a flange (30) is mounted at the exterior end of the guide tube (2).

29. Wall sleeve according to claim 28, characterized in that a sealing ring (11) is embedded in the flange (30).

30. Wall sleeve according to claim 28, characterized in that magnets (31) are embedded in the flange (30) and in the cover plate (5).

31. Wall sleeve according to claim 28, characterized in that mounting fins (32) are attached at the flange (30) which reach in the wall opening for the guide tube (2).

32. Wall sleeve according to claim 1, characterized in that a wind generator (40) is incorporated in the guide tube (2), said generator supplying electrical energy for visual effects, or for charging a rechargeable battery.

33. Wall sleeve according to claim 1, wherein said air baffle surrounds said hyperbolically shaped air stream body and the airflow passes between said hyperbolically shaped air stream body and said air baffle.

* * * * *